US008308427B2

(12) United States Patent
Tsutsui

(10) Patent No.: US 8,308,427 B2
(45) Date of Patent: Nov. 13, 2012

(54) VACUUM PUMP

(75) Inventor: Shingo Tsutsui, Kyoto (JP)

(73) Assignee: Shimadzu Corporation, Kyoto-shi (JP)

( * ) Notice: Subject to any disclaimer, the term of this patent is extended or adjusted under 35 U.S.C. 154(b) by 605 days.

(21) Appl. No.: 12/599,876

(22) PCT Filed: May 14, 2007

(86) PCT No.: PCT/JP2007/059896

§ 371 (c)(1),
(2), (4) Date: Nov. 12, 2009

(87) PCT Pub. No.: WO2008/139614

PCT Pub. Date: Nov. 20, 2008

(65) Prior Publication Data

US 2010/0215532 A1 Aug. 26, 2010

(51) Int. Cl.
*F03B 11/08* (2006.01)

(52) U.S. Cl. ..... 415/121.2; 416/247 R; 415/90

(58) Field of Classification Search ..... 416/247 R; 415/121.2, 90; 417/423.4; 210/480
See application file for complete search history.

(56) References Cited

FOREIGN PATENT DOCUMENTS

| | | | |
|---|---|---|---|
| JP | 09-057548 | A | 3/1997 |
| JP | 11-019831 | A | 1/1999 |
| JP | 11-247790 | A | 9/1999 |

OTHER PUBLICATIONS

International Search Report of PCT/JP2007/059896, mailing date of Jun. 12, 2007.

*Primary Examiner* — Edward Look
*Assistant Examiner* — Adam W Brown
(74) *Attorney, Agent, or Firm* — Westerman, Hattori, Daniels & Adrian, LLP

(57) ABSTRACT

A vacuum pump according to the invention includes a cylindrical pump casing for accommodating a rotor, a ring fitting part provided at an inlet area of the pump casing, a C-shaped ring of character C configuration devoid of portion of a ring member, fitted to the ring fitting part, and a protective net for stopping foreign matter, fitted to the inlet area by means of the C-shaped ring. As both ends of the C-shaped ring are formed so that the ends of the C-shaped ring are arranged overlapping each other in a circumferential direction in a state where the C-shaped ring is fitted to the pump casing, the deformation of the protective net for prevention of foreign matters is suppressed when air rushes into a pump casing, and therefore the dropping off of the protective net can be prevented.

10 Claims, 8 Drawing Sheets

ENLARGED VIEW OF PART A (a)

(b)

(a)

(b)

VACUUM PUMP

TECHNICAL FIELD

The present invention relates to a vacuum pump.

BACKGROUND ART

Generally, a vacuum pump with a rotor that rotates at high speeds, such as a turbomolecular pump, is provided with a protective net at an inlet area in order to prevent foreign matter from entering the pump. A generally used method for attaching the protective net at the inlet area includes a method for placing a protective net on the inlet flange and attaching a C-shaped ring for fixation of the protective net to the flange (see, for example, Cited Document 1).

Patent Document 1: Japanese Patent Laid-open Publication No. Hei-11-247790 (FIG. 4)

SUMMARY OF THE INVENTION

Problem to be Solved by the Invention

However, there has been the possibility that the protective net is deformed and dropped off to the pump side since a force exerted on the pump side is applied to overall the protective net when the pressure on the apparatus side is drastically increased, for example, by inrush of air.

Means for Solving the Problem

A vacuum pump according to the invention comprises: a cylindrical pump casing for accommodating a rotor, a ring fitting part provided at an inlet area of the pump casing, a C-shaped ring of character C configuration devoid of portion of a ring member, fitted to the ring fitting part, and a protective net for stopping foreign matter, fitted to the inlet area by means of the C-shaped ring, wherein both ends of the C-shaped ring are formed so that the ends of the C-shaped ring are arranged overlapping each other in a circumferential direction in a state where the C-shaped ring is fitted to the pump casing.

In the vacuum pump according to the invention, respective end faces of both the ends of the C-shaped ring are formed so that they oppose obliquely with respect to a radial direction of the C-shaped ring. Or, in the vacuum pump according to the invention, one end of the C-shaped ring may be bent inward to form a bent portion. By adopting any one of these two structures, the both tip portions of the C-shaped ring can be arranged overlapping each other in a circumferential direction.

In the vacuum pump according to the invention, the ring fitting part comprising a flange on which a edge portion of the protective net for prevention of foreign matter is mounted, and a groove to which the C-shaped ring is holded at a predetermined distance. Further, in the vacuum pump according to the invention, the protective net for prevention of foreign matter may include a gas passage area with a plurality of openings, with the edge portion on the flange being provided so as to surround the gas passage area.

The vacuum pump according to the invention may further comprise: rotor blades formed in the rotor, and stator blades provided opposite to the rotor blades.

Advantageous Effect of the Invention

According to the present invention, the dropping off of the protective net, for example, when air rushes into a pump casing, can be prevented.

BEST MODES FOR CARRYING OUT THE INVENTION

Figure 1:
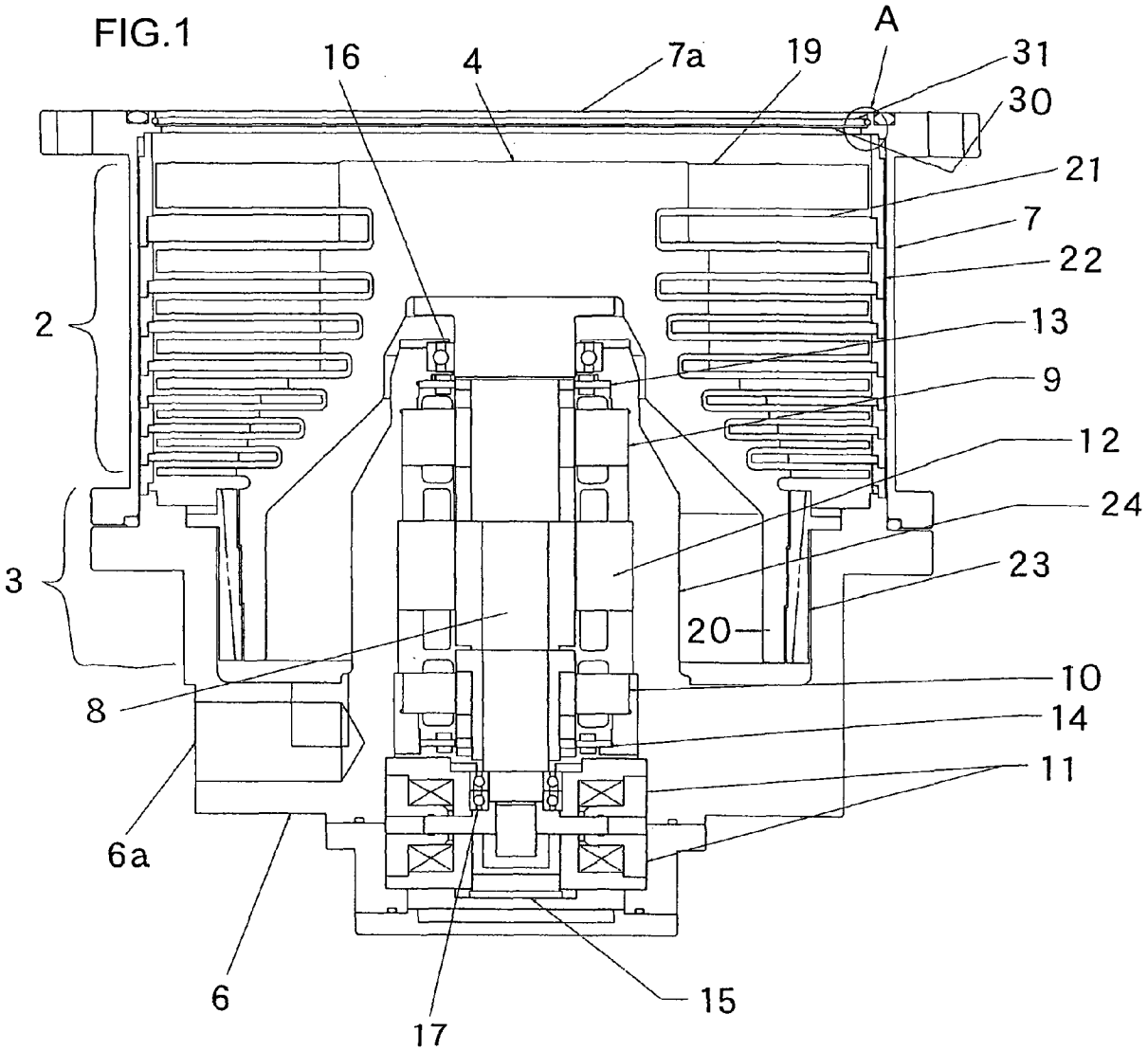
FIG. 1 is a cross-section of a rotary vacuum pump according to an embodiment of the present invention.

Hereafter, best modes for carrying out the invention will be described with reference to the drawings. FIG. 1 is a diagram showing a vacuum pump according to an embodiment of the present invention, More particularly, FIG. 1 is a cross-section of a magnetic bearing turbomolecular pump. The turbomolecular pump shown in FIG. 1 is of a type adapted to high gas load and includes a turbomolecular pump unit 2 and a thread groove pump unit 3. The turbomolecular pump unit 2 includes multiple stages consisting of rotor blades 19 and stator blades 21. The thread groove pump unit 3 consists of a thread rotor 20 and a thread stator 23.

The multiple stages consisting of the rotor blades 19 and the thread rotor 20 are formed in a rotor 4. The rotor 4 is fixed to a rotary shaft 8 that is rotatably provided in a spindle housing 24. In the spindle housing 24, there are provided in series from top of the drawing an upper radial sensor 13, an upper radial electromagnet 9, a motor stator, a lower radial electromagnet 10, a lower radial sensor 14, and a thrust electromagnet 11.

The rotary shaft 8 is contactless supported by the radial electromagnets 9, 10 and the thrust electromagnet 11 and is driven to rotate by a DC motor including the motor stator 12 and a motor rotor on the rotary shaft side. A lifted position of the rotary shaft 8 is detected by the radial sensors 13, 14 and the thrust sensor 15 provided corresponding to the radial electromagnets 9, 10 and the thrust electromagnet 11, respectively. Protective bearings 16, 17 provided on top and bottom of the rotary shaft 8, respectively, are mechanical bearings, which support the rotary shaft 8 and serve to restrict the lifted position of the rotary shaft 8 when the magnetic bearings are disabled.

On the other hand, a plurality of stator blades 21 and a thread stator 23 are provided on a base 6 in the casing 7. Each stator blade 21 is held on the base 6 such that it is sandwiched by ring-shaped spacers 22 at top and bottom thereof. By fastening the casing 7 to the base 6 with bolts, the stator blades 21 and the spacers 22 are fixed between the upper end of the casing 7 and the base 6. As a result, each stator blade 21 is positioned at a predetermined position between the rotor blades 19. The thread stator 23 is fastened onto the base 6 with bolts.

Gas molecules flowing through the inlet 7*a* are hit out by the turbomolecular pump unit 2 toward the bottom of the drawing and compressed and discharged toward the downstream side. The thread rotor 20 is provided close to the inner circumferential surface of the thread stator 23 and formed of a helical groove on the inner circumferential surface thereof In the thread groove pump unit 3, the function of discharging is realized by a viscous flow by means of the helical groove of the thread stator 23 and the thread rotor 20 that rotates at high speeds. The gas molecules compressed by the turbomolecular pump unit 2 are further compressed by the thread groove pump unit 3 and then discharged from an outlet 6*a*.

Figure 2:
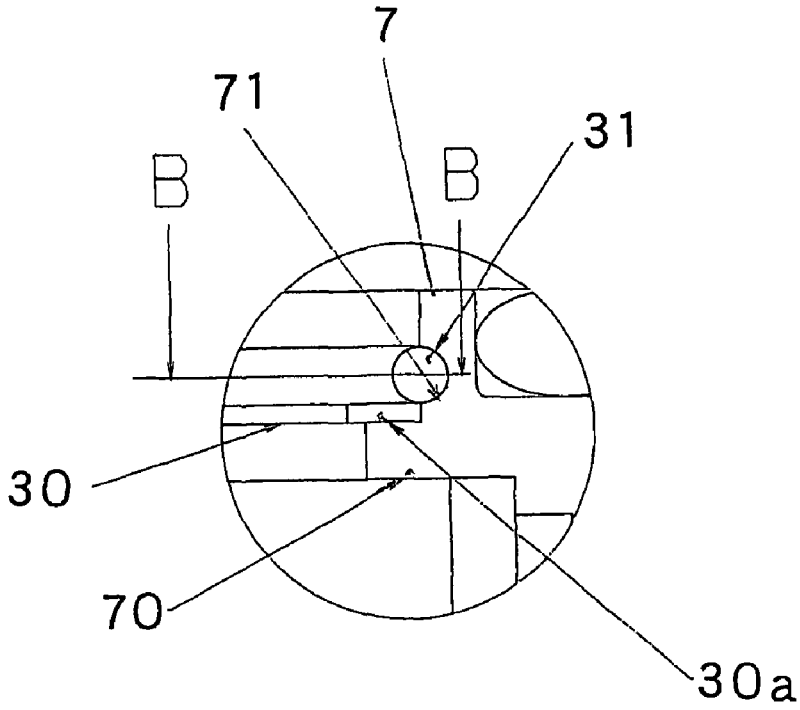
FIG. 2 is an enlarged view of the part A in FIG. 1.

The inlet 7*a* of the casing 7 is provided with a protective net 30 for stopping contamination of foreign matter from the side of the apparatus. The casing 7 is provided with a C-shaped ring 31 for preventing the protective net 30 from coming off from the casing 7. FIG. 2 is an enlarged view of the part A shown in FIG. 1. On the inner circumferential surface of the casing 7 is formed a ring-shaped flange 70 and the protective net 30 is placed on the flange 70. In the upper inner circumferential surface of the flange 70 is formed a groove 71 for fitting the C-shaped ring 31 therein. The C-shaped ring 31 is fitted in the groove 71 by an elastic force generated when the C-shaped ring 31 per se is deformed. The fitted C-shaped ring 31 projects upward above an outer peripheral rib portion 30*a* of the protective net 30 so that the protective net 30 will not come off from the casing 7 even when the pump is at a slant or arranged upside down.

Figure 3:
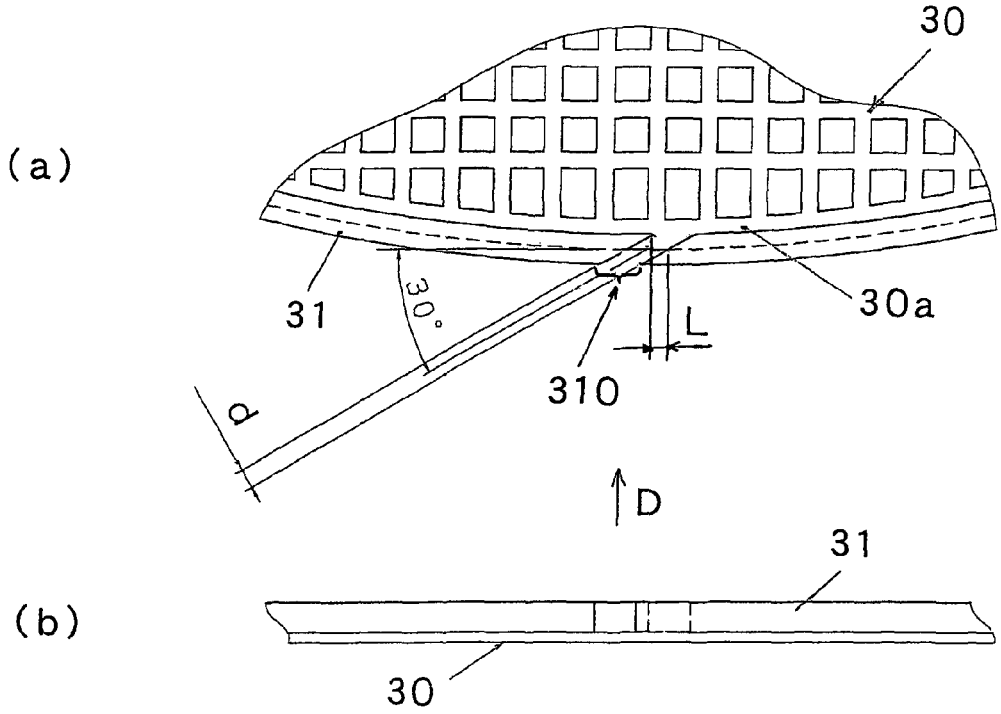
FIG. 3(*a*) is a B-B cross-section of FIG. 2, with (b) being a view on arrow D.

FIG. 3 illustrates the configuration of the C-shaped ring 31, with (a) being a cross-section along the line B-B of FIG. 2, (*b*) being a view taken in the direction of D. The C-shaped ring 31, which is made of an elastic material such as spring steel, is obtained by working a wire made of spring steel into a ring-shaped structure having obliquely cut joint lines. Obliquely cut portion 310 has a gap size d of about 2 mm from each other. Needless to say, the gap size is not limited to 2 mm. However, it is preferred that the gap is as small as possible in order to prevent the dropping out of the protective net as will be described later on.

Since both ends of the C-shaped ring 31 are arranged overlapping each other in the circumferential direction as shown in FIG. 3(*b*), when the C-shaped ring 31 is viewed in the direction D (in the radial direction), the left side end thereof is overlapped by and behind the right side end thereof so that it is not seen. The obliquely cut portion 310 is at an angle of 30 degrees with respect to a tangential line. By cutting the C-shaped ring 31 obliquely as mentioned above, the outer circumferential rib portion 30*a* of the protective net 30 except for a portion along a size L can be held by the C-shaped ring 30. The size L can be made as small as possible by making the gap size d between the obliquely cut portions 300 as small as possible.

Figure 4:
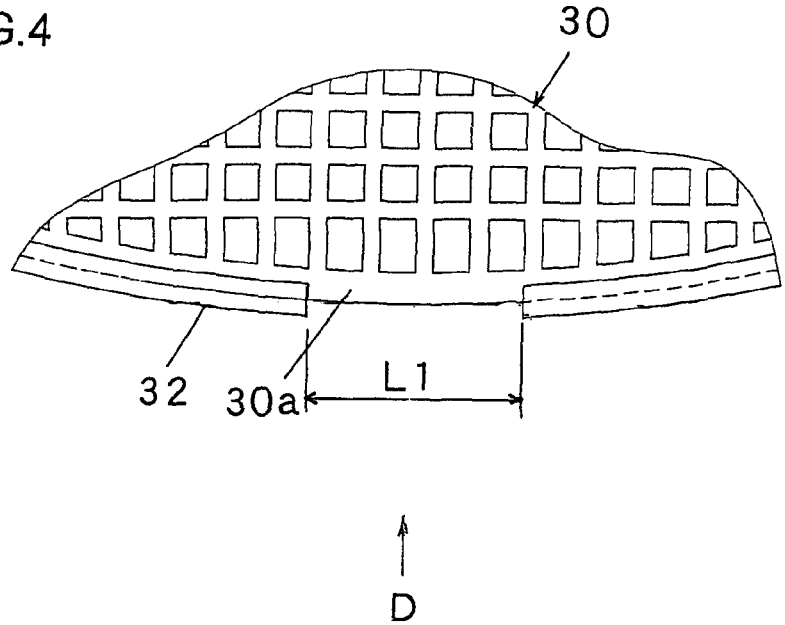
FIG. 4(*a*) is a plan view showing portions of the protective net 30 and the C-shaped ring 32, respectively, with (b) being a view on arrow D.
Figure 4:
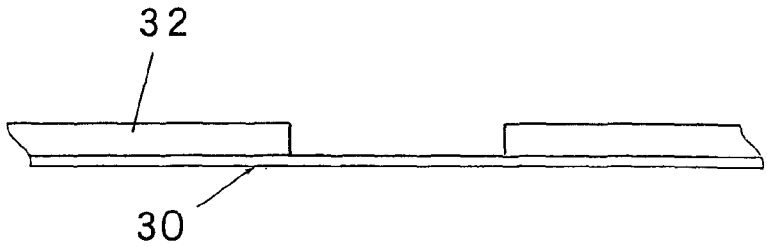

FIG. 4 shows an example of the C-shaped ring in the conventional turbomolecular pump. A C-shaped ring 32 is obtained by working a wire of spring steel into C-shaped structure in the same manner as the above-mentioned C-shaped ring 31. However, both ends thereof are not obliquely cut. When fitting the C-shaped ring 32 into the groove 71 of the casing 7, the C-shaped ring 32 is deformed so that the diameter of the C-shaped ring 32 is decreased as shown in FIG. 5(*a*) before it can be fitted into the groove 71.

Figure 5:
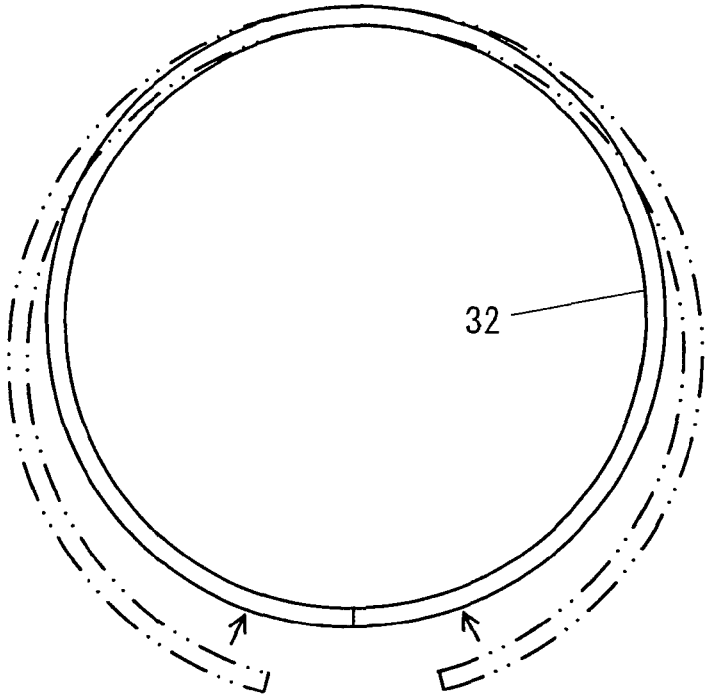
FIG. 5(*a*) is a plan view showing the C-shaped ring 32 when it is deformed, with (b) being a plan view showing the C-shaped ring 31 when it is deformed.
Figure 5:
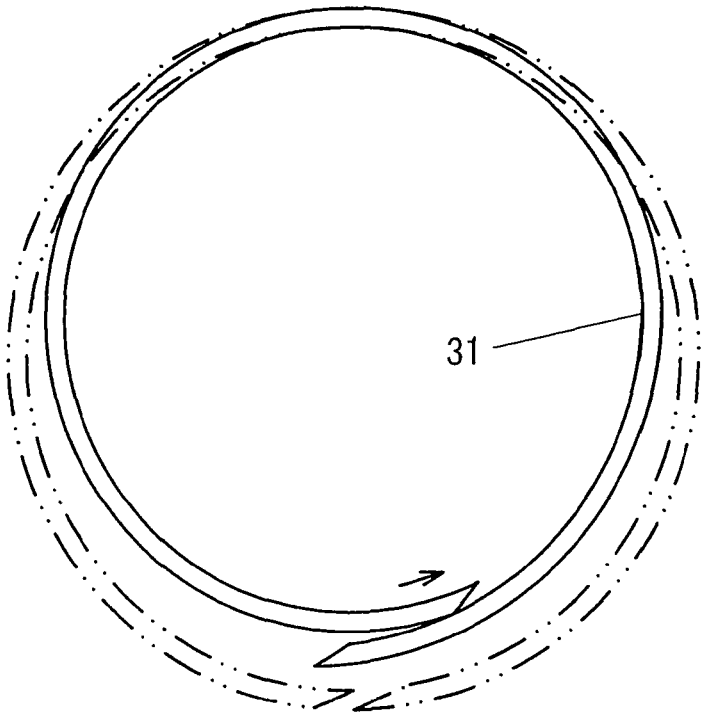

In this case, if a gap size L1 between the ends of the C-shaped ring 32 shown in FIG. 4(*a*) is too small, the ends will contact each other as shown in a solid line in FIG. 5(*a*) when the C-shaped ring 32 is deformed and sometimes it fails to be fitted. Therefore, the gap L1 is set to a greater value such that fitting into or out from the groove 71 of the C-shaped ring 32 can be made easier even when the ends contact each other upon deformation. For example, the gap L1 is set to about 20 mm.

On the other hand, since the ends of the ring are obliquely shaped in the C-shaped ring 31, the ends will slide on each other if they contact each other when the C-shaped ring 31 is deformed upon fitting, so that they will be deformed such that one of them goes into inside of the other as shown in FIG. 5(*b*). As a result, the fitting of the C-shaped ring 31 into and out from the groove 71 can be performed easily even when the gap size d shown in FIG. 3(*a*) is set to a small value.

As mentioned above, since the size L1 should be set to a large value in the case of the conventional C-shaped ring 32, an area of the outer peripheral rib portion 30*a* of the protective net 30 that cannot be held by the C-shaped ring 32 tends to become larger. On the other hand, in the case of the C-shaped ring 31, the area that cannot be held by the C-shaped ring 31 can be made smaller since the ends are shaped obliquely. In particular, by increasing the oblique angle so as to make L<0, it is possible to avoid the area that cannot be held by the c-shaped ring 31 all around the periphery thereof As shown in FIG. 4, the protective net 30 tends to be drawn into the casing 7, for example, when air rushes in if there is any area that cannot be held by the C-shaped ring 32 along the circumferential area of the protective ring 32. Hereafter, explanation is made on the reason why the protective net 30 is deformed to a greater extent toward the pump side and comes off upon the inrush of air and how the coming off can be prevented in the pump according to the embodiment of the present invention with reference to FIGS. 6 and 7.

Figure 6:
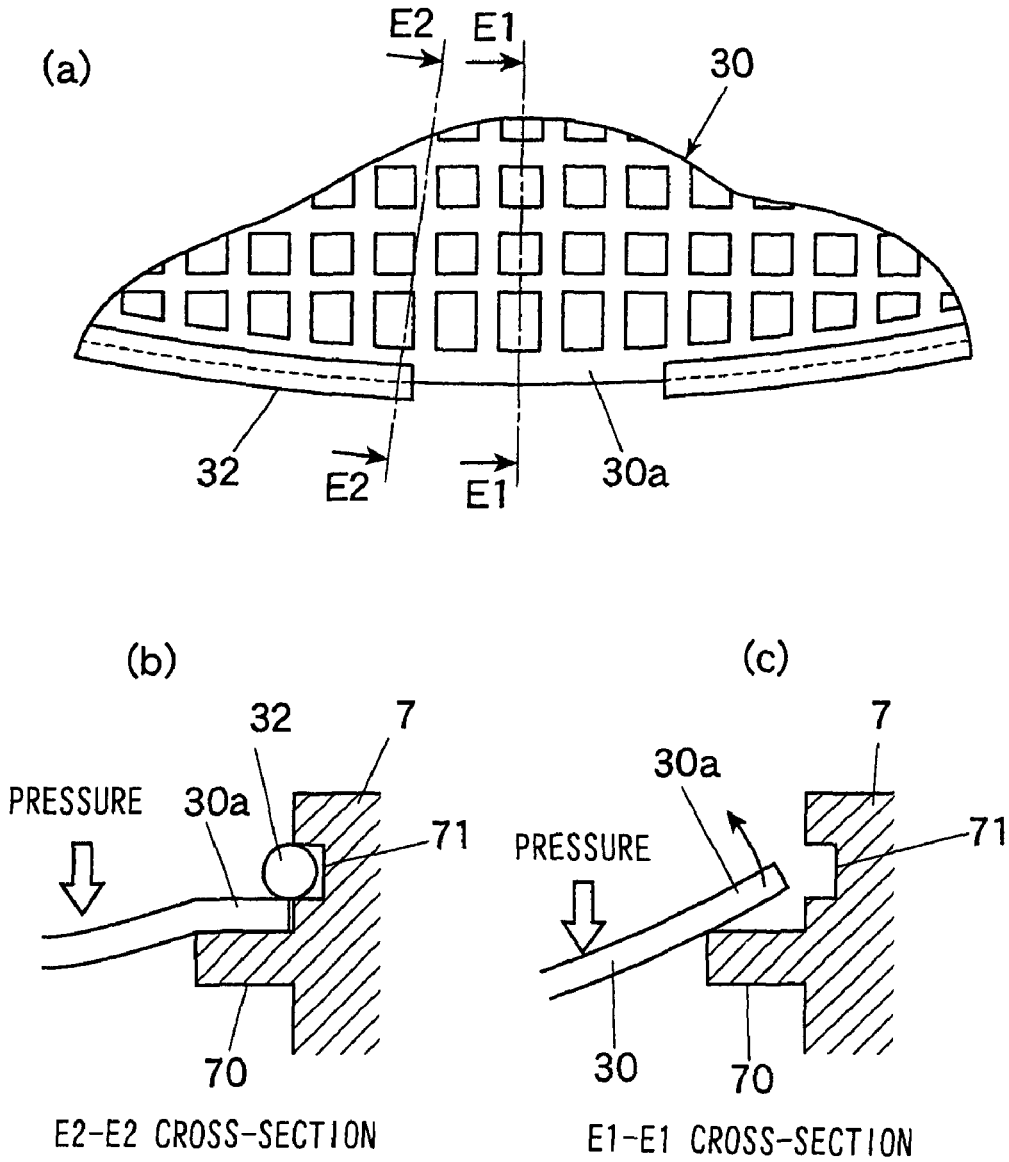
FIG. 6 is a diagram illustrating dropping off of the protective net 30, with (a) being a plan view showing portions of the protective net 30 and the C-shaped ring 32, (b) being an E2-E2 cross-section, (c) being an E1-E1 cross-section, and (d) being a diagram illustrating deformation of the protective net 30.
Figure 6:
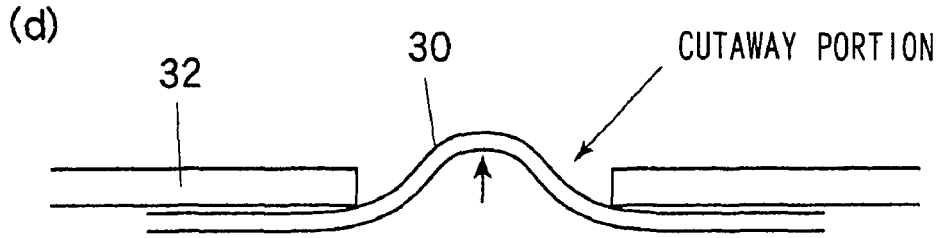

FIG. 6(*a*) is a diagram similar to that shown in FIG. 4(*a*) and shows a cutaway portion of the C-shaped ring 32. FIG. 6(*b*) shows an E2-E2 cross-section. FIG. 6(*c*) shows an E1-E1 cross-section. When pressure is applied onto the upper surface of the protective net 30 as a result of inrush of air, the portion of the protective net 30 that is on the inside of the flange 70 is deformed downward in the drawing in the cutaway portion of the C-shaped ring 32 shown in the E1-E1 cross-section and on the contrary, the outer circumferential rib portion 30*a* is lifted upward in the drawing.

On the other hand, in the portion shown in the E2-E2 cross-section, the upward lifting of the outer circumferential rib portion 30*a* is prevented by the C-shaped ring 32. As a result, the protective net 30 in the cutaway portion of the C-shaped ring is deformed as shown in FIG. 6(*d*), so that the protective net 30 sags in the middle to a greater extent and the outer circumferential rib portion 30*a* comes off from the flange 70. The protective net 30 that has come off contacts the rotor blade 19 of the rotor 4 to damage the rotor blade 19.

Figure 7:
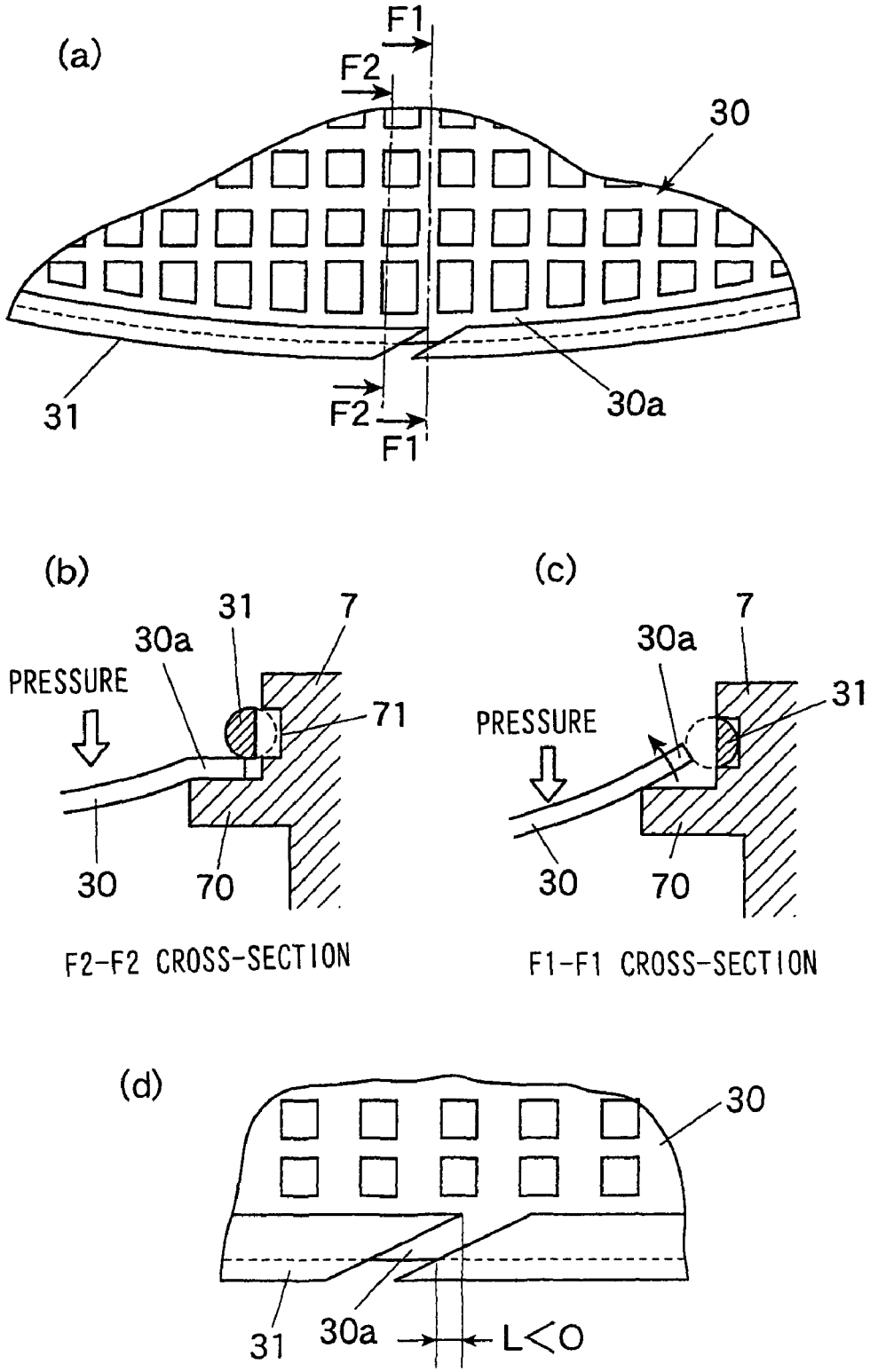
FIG. 7 is a diagram illustrating dropping off of the protective net 30, with (a) being a plan view showing portions of the protective net 30 and the C-shaped ring 32, (b) being an F2-F2 cross-section, (c) being an F1-F1 cross-section, and (d) being a diagram showing a portion of the C-shaped ring 31 when L<0.

FIG. 7(*a*) is a diagram similar to that shown in FIG. 3(*a*) and shows a cutaway portion of the C-shaped ring 31. FIG. 7(*b*) shows an F2-F2 cross-section. 7(c) is an F1-F1 cross-section. In the case of the cross-section along the line F2-F2, the tip portion of the obliquely cut C-shaped ring 31 are above the outer circumferential rib portion 30*a* of the protective net 30, so that the outer circumferential rib portion 30*a* will not be pushed upwards even when the protective net 30 is deformed downward in the drawing due to the pressure upon inrush of air.

On the other hand, in the F1-F1 cross-section, which is a cross-section in the range of size L in FIG. 3(*a*), there is no C-shaped ring 31 above the outer circumferential rib portion 30*a* as shown in FIG. 7(*c*), so that there is a possibility that the outer circumferential rib portion 30*a* will be lifted upwards as shown in the drawing. However, since the cutaway portion of the C-shaped ring 31 is shaped obliquely, the size L is small and hence there is no room for the cutaway portion to be deformed upwards as shown in FIG. 6(*d*). This prevents the outer circumferential rib portion 30*a* from being lifted upwards. As a result, the protective net 30 is prevented from being deformed to a greater extent toward the side of the pump upon inrush of air and there will be no dropping off of the protective net 30 from the casing 7.

FIG. 7(*d*) shows the case where the angle of the oblique cut is made smaller and the size L is L<0. In this case, the situation like that shown in FIG. 7(*c*) will not occur and the dropping off of the protective net 30 upon inrush of air can be prevented without fault. L<0 can be obtained by making the gap size d of the cutaway portion smaller instead of making the angle of oblique cut smaller.

Figure 8:
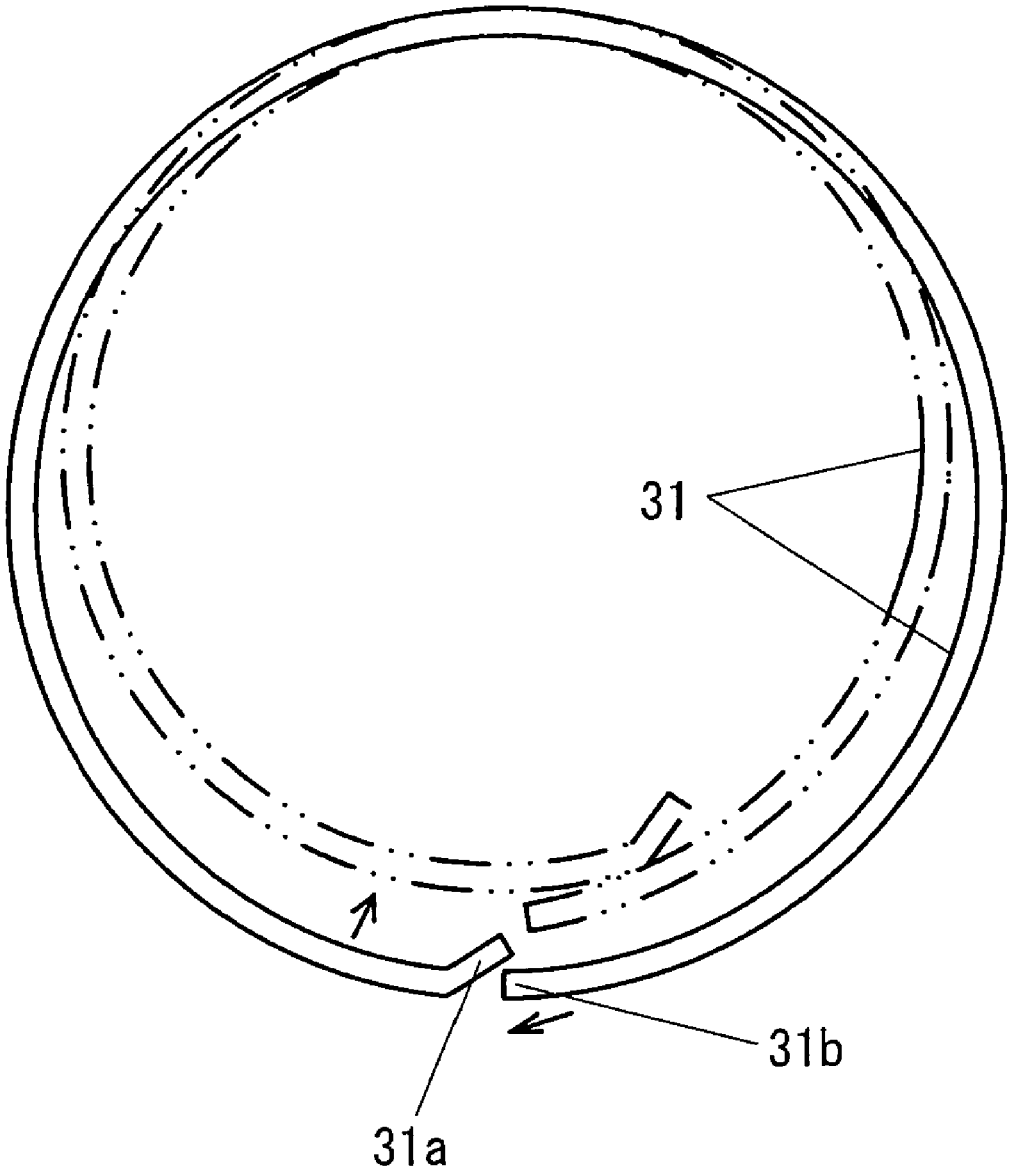
FIG. 8 is a diagram showing the C-shaped ring 31 according to a variation.

FIG. 8 is a diagram showing a variation of the C-shaped ring 31. The above-mentioned C-shaped ring 31 is obtained by obliquely cutting away a ring-shaped wire. The C-shaped ring 31 shown in FIG. 8, however, has a configuration that is obtained by bending one end of the conventional C-shaped ring 32 inward. The tip of a bent portion 31*a* and the other end 31*b* are seen overlapping each other when they are viewed in the radial direction. As a result, the entire circumference of the outer circumferential rib portion 30*a* of the protective net 30 can be held by the C-shaped ring 31.

In the above-mentioned embodiments, the C-shaped ring 31 is formed using a wire, so that it has a circular cross-section. However, the C-shaped rig 31 may have a cross-section other than a circular one. The state in which the ends of the C-shaped ring 31 are arranged overlapping each other in the circumferential direction may be required when the C-shaped ring 31 is fitted in the groove 71 but in a state where it is not fitted, the ends of the C-shaped ring 31 need not be arranged overlapping each other in the circumferential direction. In the above-mentioned embodiments, explanation has been made taking an example of a turbomolecular pump. However, the present invention is not limited to the turbomolecular pump but is similarly applicable to any vacuum pump having a rotor that rotates, such as a molecular drag pump. The present invention is not limited to the above-mentioned embodiments as far as the features of the present invention are not impaired.

The invention claimed is:

1. A vacuum pump comprising:

a cylindrical pump casing for accommodating a rotor;

a ring fitting part provided at an inlet area of the pump casing;

a C-shaped ring of character C configuration devoid of portion of a ring member, fitted to the ring fitting part; and a protective net for stopping foreign matter, fitted to the inlet area by means of the C-shaped ring, wherein both ends of the C-shaped ring are formed so that the ends of the C-shaped ring are arranged overlapping each other in a circumferential direction in a state where the C-shaped ring is fitted to the pump casing.

2. The vacuum pump according to claim 1, wherein respective end faces of both the ends of the C-shaped ring are formed so that they oppose obliquely with respect to a radial direction of the C-shaped ring.

3. The vacuum pump according to claim 1, wherein one end of the C-shaped ring is bent inward to form a bent portion, and a tip of the bent portion and the other end of the C-shaped ring are arranged overlapping each other in a circumferential direction.

4. The vacuum pump according to claim 1, wherein the ring fitting part comprises a flange on which a edge portion of the protective net for prevention of foreign matter is mounted, and a groove to which the C-shaped ring is held at a predetermined distance.

5. The vacuum pump according to claim 4, wherein the protective net for prevention of foreign matter includes a gas passage area with a plurality of openings, with the edge portion on the flange being provided so as to surround the gas passage area.

6. The vacuum pump according to claim 1, further comprising:

rotor blades formed in the rotor; and stator blades provided opposite to the rotor blades.

7. The vacuum pump according to claim 2, wherein the ring fitting part comprises a flange on which a edge portion of the protective net for prevention of foreign matter is mounted, and a groove to which the C-shaped ring is held at a predetermined distance.

8. The vacuum pump according to claim 3, wherein the ring fitting part comprises a flange on which a edge portion of the protective net for prevention of foreign matter is mounted, and a groove to which the C-shaped ring is held at a predetermined distance.

9. The vacuum pump according to claim 2, further comprising:

rotor blades formed in the rotor; and stator blades provided opposite to the rotor blades.

10. The vacuum pump according to claim 3, further comprising:

rotor blades formed in the rotor; and stator blades provided opposite to the rotor blades.

* * * * *